US010626003B2

(12) United States Patent
Wyatt et al.

(10) Patent No.: US 10,626,003 B2
(45) Date of Patent: Apr. 21, 2020

(54) POST-MIX DRINK DISPENSING SYSTEM WITH INDEPENDENTLY CONTROLLED SYRUP PUMPS

(71) Applicant: WELBILT (HALESOWEN) LIMITED, Halesowen (GB)

(72) Inventors: Gary Wyatt, Halesowen (GB); Nigel Mobbs, Halesowen (GB)

(73) Assignee: WELBILT (HALESOWEN) LIMITED, Halesowen (GB)

( * ) Notice: Subject to any disclaimer, the term of this patent is extended or adjusted under 35 U.S.C. 154(b) by 0 days.

(21) Appl. No.: 15/772,965

(22) PCT Filed: Nov. 2, 2016

(86) PCT No.: PCT/GB2016/053401
§ 371 (c)(1),
(2) Date: May 2, 2018

(87) PCT Pub. No.: WO2017/077295
PCT Pub. Date: May 11, 2017

(65) Prior Publication Data

US 2018/0354771 A1 Dec. 13, 2018

(30) Foreign Application Priority Data

Nov. 3, 2015 (GB) ..... 1519393.1

(51) Int. Cl.
*B67D 1/00* (2006.01)
*B67D 1/12* (2006.01)
(Continued)

(52) U.S. Cl.
CPC ..... *B67D 1/0037* (2013.01); *B67D 1/004* (2013.01); *B67D 1/0039* (2013.01);
(Continued)

(58) Field of Classification Search
CPC .. B67D 1/0888; B67D 1/0034; B67D 1/0036; B67D 1/0037; B67D 1/0039;
(Continued)

(56) References Cited

U.S. PATENT DOCUMENTS 4,304,736 A * 12/1981 McMillin ..... B67D 1/0073 261/35
4,742,939 A * 5/1988 Galockin ..... B67D 1/0021 137/101.27
(Continued)

FOREIGN PATENT DOCUMENTS

CA 2 501 127 A1 10/2005
EP 1 420 652 A1 5/2004
(Continued)

OTHER PUBLICATIONS

International Search Report and Written Opinion for Application No. PCT/GB2016/053401, dated Feb. 22, 2017.
(Continued)

*Primary Examiner* — Charles Cheyney
(74) *Attorney, Agent, or Firm* — Marshall, Gerstein & Borun LLP

(57) ABSTRACT

Drinks dispensing system (10) comprising a first syrup pump (20) being controllable to deliver a predetermined dose of syrup from a first syrup container (22) to a dispensing valve assembly (16), a second syrup pump (20) being controllable to deliver a predetermined dose of syrup from a second syrup container (22) to the dispensing valve assembly (16), a control system (200) configured to control the operation of the first and second syrup pumps (20) by setting a first electrical power parameter of electrical power to be supplied to drive the first syrup pump (20) independently of a second electrical power parameter of electrical power to be supplied to drive the second syrup pump (20); and a water delivery system (14) configured to deliver water
(Continued)

to the dispensing valve assembly (16), wherein the dispensing valve assembly (16) is operable to mix and dispense syrup and water.

12 Claims, 7 Drawing Sheets

(51) Int. Cl.
*B67D 1/08* (2006.01)
*B67D 1/10* (2006.01)
*B67D 1/07* (2006.01)

(52) U.S. Cl.
CPC ..... *B67D 1/0044* (2013.01); *B67D 1/0068* (2013.01); *B67D 1/0075* (2013.01); *B67D 1/0864* (2013.01); *B67D 1/0867* (2013.01); *B67D 1/0888* (2013.01); *B67D 1/108* (2013.01); *B67D 1/1204* (2013.01); *B67D 1/1231* (2013.01); *B67D 1/1293* (2013.01); *B67D 1/1297* (2013.01); *B67D 1/07* (2013.01); *B67D 2001/0827* (2013.01)

(58) Field of Classification Search
CPC .... B67D 1/004; B67D 1/0044; B67D 1/0068; B67D 1/0075; B67D 1/0864; B67D 1/0867; B67D 1/108; B67D 1/1204; B67D 1/1231; B67D 1/1293; B67D 1/1297; B67D 1/07
USPC ..... 222/52, 129.1, 129.4, 385, 132
See application file for complete search history.

(56) References Cited

U.S. PATENT DOCUMENTS 4,781,310 A * 11/1988 Credle, Jr. ..... B67D 1/0021 222/129.1
4,801,048 A * 1/1989 Credle, Jr. ..... B67D 1/0021 222/129.1
5,350,082 A * 9/1994 Kiriakides, Jr. ..... G07F 13/065 221/1
5,419,461 A * 5/1995 Goulet ..... B67D 1/0057 222/129.1
5,537,838 A * 7/1996 Mills ..... B67D 1/06 62/400
5,556,006 A * 9/1996 Sano ..... B67D 1/0022 222/129.1
5,592,867 A * 1/1997 Walsh ..... B67D 1/0057 261/DIG. 7
6,178,875 B1 * 1/2001 Edwards ..... A23L 2/54 261/128
6,202,894 B1 * 3/2001 Struminski ..... B67D 1/0037 222/129.3
6,756,069 B2 * 6/2004 Scoville ..... A23F 5/243 426/119
7,036,687 B1 * 5/2006 Lowe ..... A47J 31/401 222/129.1
7,559,346 B2 * 7/2009 Herrick ..... A23C 9/133 141/102
7,597,922 B2 * 10/2009 Cheng ..... A23L 27/00 426/594
7,661,352 B2 * 2/2010 Sher ..... B67D 1/0021 222/129.1
7,905,373 B2 * 3/2011 Beavis ..... F04B 13/02 222/1
7,997,448 B1 8/2011 Leyva
8,327,607 B2 * 12/2012 Nighy ..... B65B 3/045 141/313
8,463,447 B2 * 6/2013 Newman ..... B67D 1/0021 700/283
8,505,777 B2 * 8/2013 Romanyszyn ..... B67D 1/07 222/129.1
2002/0060226 A1 5/2002 Kameyama
2007/0009365 A1 1/2007 Litterst et al.
2013/0001249 A1 * 1/2013 Wiemer ..... B67D 1/0021 222/25
2015/0014357 A1 1/2015 Beavis et al.

FOREIGN PATENT DOCUMENTS

EP 1 955 977 A1 8/2008
EP 2 384 649 A1 11/2011
WO WO-2006/036353 A1 4/2006

OTHER PUBLICATIONS

Search Report for Application No. GB1519393.1, dated Apr. 28, 2016.

* cited by examiner

POST-MIX DRINK DISPENSING SYSTEM WITH INDEPENDENTLY CONTROLLED SYRUP PUMPS

DESCRIPTION OF INVENTION

Embodiments of the present invention relate to drinks dispensing systems. More particularly embodiments relate to drinks dispensing systems for use on a counter top and may be for supplying carbonated drinks.

Drinks dispensing systems which dispense soft drinks are well known in the beverage industry. In the context of the present application, references to "soft drinks" are references to drinks made from a mixture of a concentrate, in the form of a syrup, and water. This may include carbonated soft drinks, otherwise variously known as sodas and pops, for example.

In commercial settings, the most common way to create a carbonated soft drink is to carbonate water, and combine it with a particular syrup flavour in a dispensing system at the point of dispensing the drink. Generally, such dispensing systems are used in venues which serve high volumes of soft drinks (for example, public houses, hotels, restaurants, bars, and sports stadiums).

Typically, a dispensing system for carbonated soft drinks will include a carbonation system and a syrup system. The carbonation system connects to a water source and a carbon dioxide source, and provides a pressurised container (known as a "carbonator bowl") in which carbon dioxide from the carbon dioxide source is dissolved into water from the water source.

The syrup system connects multiple pumps to multiple containers of different flavoured syrups, so that each syrup can be pumped into the carbonated water, when required. Typically, the syrup is added to a stream of carbonated water during dispensing—see below.

Both the carbonation system and syrup system are cooled, so that the dispensed soft drink is chilled relative to room temperature. Accordingly, the dispensing system may include a cooling system for this purpose.

Generally, each syrup pump is connected to a respective dispensing tap, which dispenses the soft drink flavoured by the syrup which that syrup pump delivers to the stream of carbonated water. In other words, in many dispensing systems, each dispensing tap dispenses a particular flavour of soft drink (for example, cola or lemonade).

Usually, only the dispensing taps are provided at bar level and the other components (such as the carbonation system and syrup system) are provided elsewhere (for example, in a basement, where there may be more space).

In use, when a dispensing tap is activated, syrup is pumped from its respective container through the cooling system, and water is provided from the water source (e.g. mains water) through the carbonation system and cooling system. Syrup and carbonated water are mixed at an optimal ratio to provide an ideal concentration of soft drink. The optimal ration of syrup and carbonated water may be a balance of a number of factors including the flavour of the resulting soft drink and the volume of syrup used for a particular volume of soft drink (which, of course, influences the cost of providing the soft drink).

Valves are required to regulate the flow rate of the syrup and the water. Typically, the syrup system has a separate valve for each syrup. This valve dictates the flow rate of that syrup and must be set specifically for that particular syrup. Different syrups may require different valve settings due to different optimal ratios and/or different properties of the syrups (e.g. different viscosities). The valves may be part of the dispensing system which is located remotely with respect to the dispensing taps or may be part of the dispensing taps.

These valves not only need to be adjusted if a new type of syrup is to be used, but also may drift from a setting over time. This can result in inconsistent flow rates (and as such incorrect syrup to water ratios), high malfunction rates (because valves can break down relatively quickly), and it may be difficult to access parts of the system, since they may be in a basement, for example. This leads to high maintenance costs for proprietors in order to maintain a fully operational and consistent dispensing system.

Additionally, not all venues are suitable for such a high capacity system. For example, space in some venues is limited and, in some venues, the volume of soft drink sold is so low that the capital, installation, and/or maintenance cost for a conventional dispensing system means that the conventional system is not economically viable.

Therefore, there is a need to reduce the size of dispensing systems such as those described above, so that venues with limited space can also provide soft drinks of this kind. There is also a need to reduce maintenance costs.

Some conventional relatively compact dispensing systems exist. These systems typically connect to an external water source and carbon dioxide source, but the syrups, pumps, cooler and carbonator are included in a single unit. Multiple dispensing taps are provided, each of which connects to a different syrup pump and container, so that each provides a different flavour soft drink. These systems are easier to access, so they are more suitable for small venues. However, maintenance costs are still relatively high because the valves need to be adjusted for each syrup, and similar problems to the larger systems described above can occur.

U.S. Pat. No. 7,997,448 discloses a multiple beverage dispensing apparatus for selectively dispensing a beverage which is stored in a concentrated form. The apparatus includes a plurality of pumps which are driven by a single motor via a single rotor and a plurality of clutches.

The present invention aims to alleviate one or more problems associated with the prior art.

An aspect of the present invention provides a drinks dispensing system for dispensing drinks comprising: a dispensing valve assembly; a syrup delivery system comprising: a first syrup pump for connection to a first syrup container, the first syrup pump being controllable to deliver a predetermined dose of syrup from the first syrup container to the dispensing valve assembly, and a second syrup pump for connection to a second syrup container, the second syrup pump being controllable to deliver a predetermined dose of syrup from the second syrup container to the dispensing valve assembly; a control system configured to control the operation of the first and second syrup pumps by setting a first electrical power parameter of electrical power to be supplied to drive the first syrup pump independently of a second electrical power parameter of electrical power to be supplied to drive the second syrup pump; and a water delivery system configured to deliver water to the dispensing valve assembly, wherein the dispensing valve assembly is operable to mix and dispense syrup and water provided by the syrup delivery system and the water delivery system.

The control system may be configured to set the first and second electrical power parameters to different settings.

The electrical power parameter may be a voltage of the electrical power to be supplied to the first and second syrup pumps.

The control system may include a first controller associated with the first syrup pump and a second controller associated with the second syrup pump, each controller being configured to receive operator input to set the respective first and second electrical power parameters.

The control system may be further configured to: receive a command to dispense a drink; control the delivery to the dispensing valve assembly of a syrup using first syrup pump; and control the delivery of water to the dispensing valve assembly using the water delivery system, such that water only is dispensed during a final period of the dispensing of the drink in order to flush the dispensing valve assembly.

The system may further include a third syrup pump for connection to a third syrup container, the third syrup pump being controllable to deliver a predetermined dose of syrup from the third syrup container to the dispensing valve assembly, wherein the control system is further configured to control the operation of the third syrup pump by setting a third electrical power parameter of electrical power to be supplied to drive the third syrup pump independently of the first and second electrical power parameters.

The syrup delivery system, the water delivery system and the dispensing valve assembly may all be housed within or on a single housing.

The syrup delivery system may further include a container for housing a replaceable syrup bag.

The first and second syrup pumps may be both peristaltic pumps.

The system may further include a cooling system configured to cool at least part of the syrup delivery system and/or the water delivery system.

Parts of both the syrup delivery system and the water delivery system may be cooled using a single cooling system.

The dispensing valve assembly may be configured to control the flow rate of water from the water delivery system.

The dispensing valve assembly may be configured to pass the syrup from the first and second syrup containers without providing control over the flow rate of the syrup.

The water delivery system may include a carbonation device having a pressurised reservoir of water and carbon dioxide.

The carbonation device may be configured to refill the reservoir to a predetermined level after a drink has been dispensed.

Embodiments of the invention will now be described with reference to the accompanying figures of which:

Figure 1:
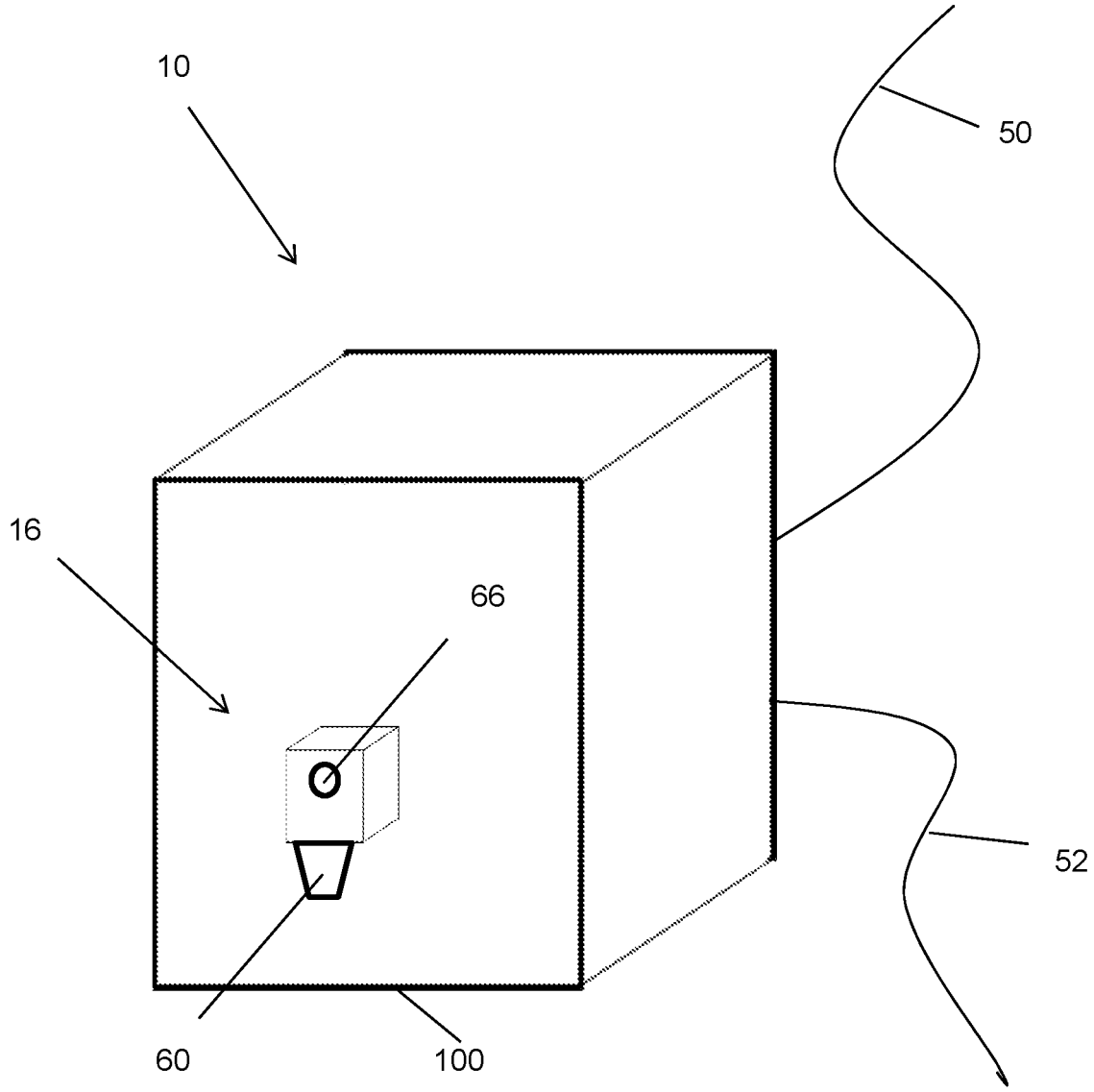
FIG. 1 shows a drinks dispensing system in accordance with some embodiments of the invention.
Figure 2:
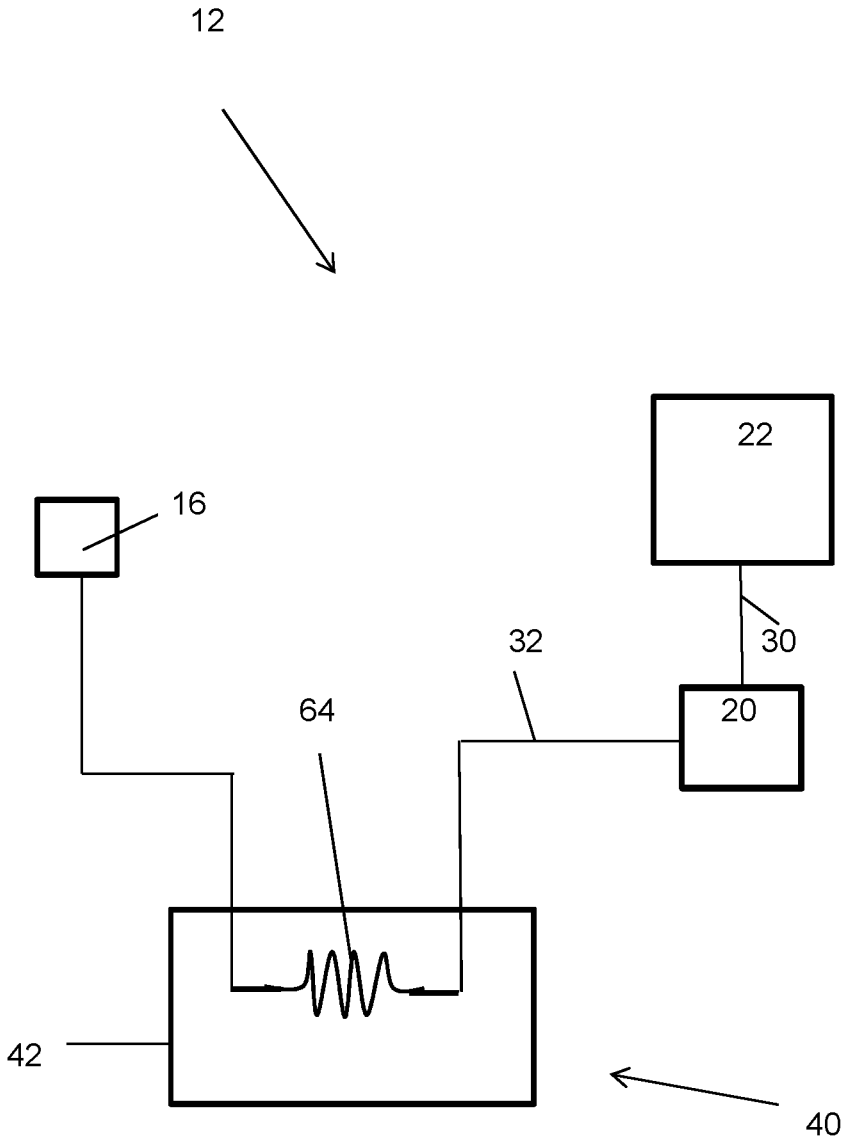
FIG. 2 shows a schematic view of a syrup delivery system for use in a drinks delivery system in accordance with some embodiments of the invention.
Figure 3:
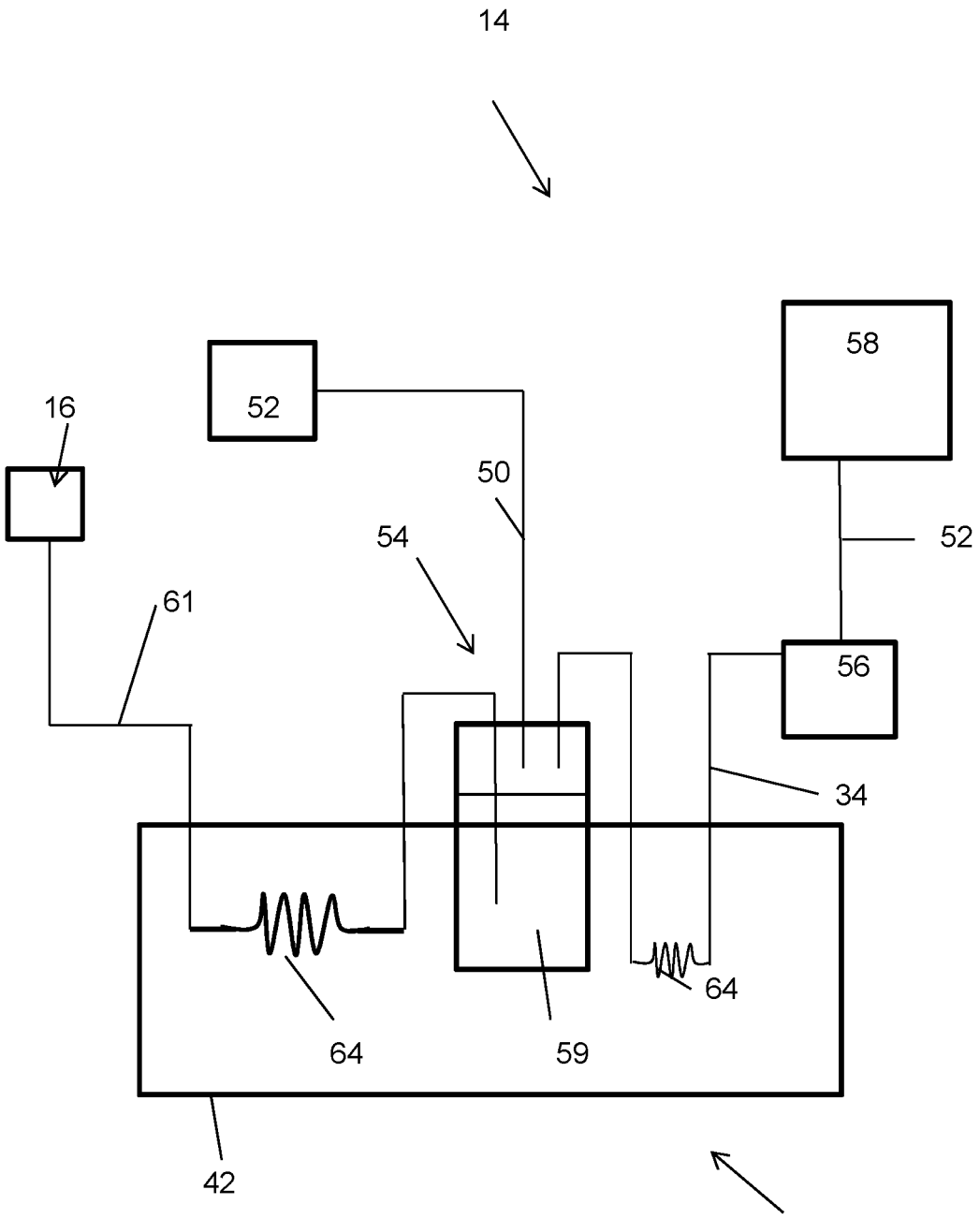
FIG. 3 shows a schematic view of a carbonated water delivery system for use in a drinks dispensing system in accordance with some embodiments of the invention.

With reference to the figures a drinks dispensing system 10 of some embodiments is shown. The drinks dispensing system 10 includes a syrup delivery system 12, a water delivery system 14 and a dispensing valve assembly 16. The syrup delivery system 12 and the water delivery system 14 deliver syrup and water, respectively, to the dispensing valve assembly 16, so that a soft drink can be dispensed. The syrup delivery system 12, the water delivery system 14 and the dispensing valve assembly 16 may all be housed on or within a housing 100, which may be a single housing 100.

The syrup delivery system 12 includes a syrup pump 20 for connection to a syrup container 22 such that the syrup pump 20 can pump syrup from the syrup container 22 towards the dispensing valve assembly 16. The connection between the syrup pump 20 and the syrup container 22 may be through a conduit 30 which is part of the syrup delivery system 12 or which is connectable to the syrup delivery system 12 (e.g. to an inlet of the syrup pump 20)—such that syrup is drawn from the syrup container 22 through the conduit 30 by the syrup pump 20 for delivery towards the dispensing valve assembly 16.

The syrup container 22 is configured to hold and store a volume of syrup for use by the syrup delivery system 12. The syrup container 22 may, therefore, be a bag of syrup which may be connected directly to the conduit 30 (i.e. so that the bag can be replaced when it is empty). In such embodiments, the syrup container 22 may be a bag of syrup provided inside another container such as a box (which may be constructed from cardboard or the like)—e.g. a bag-in-a-box.

In some embodiments, the syrup container 22 may include a housing configured to receive the bag of syrup (or bag-in-a-box) and provide a connection to the conduit 30. In some embodiments, the syrup container 22 may include a housing which provides a reservoir in which syrup may be directly poured and stored, and which also provides a connection to the conduit 30. The syrup container 22 may, therefore, in some embodiments be filled in-situ (i.e. whilst still connected to the syrup delivery system 12).

In some embodiments, the syrup container 22 may form part of the syrup delivery system 12. The syrup container 22 described herein is an example of a source of syrup which may be connected to the syrup pump 20 (via the conduit 30 or otherwise) and other sources of syrup may be used.

The syrup pump 20 is configured to deliver a predetermined dose of syrup from the syrup container 22 (or other source of syrup) to the dispensing valve assembly 16.

In some embodiments, the syrup pump 20 may be a peristaltic pump which is configured to deliver the predetermined dose (i.e. a predetermined volume) of syrup to the dispensing valve assembly 16.

In some embodiments, the syrup pump 20 in the form of a peristaltic pump includes a compressible tube 24 which is compressed and sealed ("occluded"), by a rotating rotor 26 with at least two spaced apart rollers 28. The dimensions of the syrup pump 20 and/or the tube 24 and/or the rotor 26/rollers 28 may be selected so that the desired dose of syrup is delivered by driving the syrup pump 20. The syrup pump 20, therefore, has a pump volume which is the volume of a single dose of syrup (and, in some embodiments, the minimum volume of syrup the syrup pump 20 is configured to deliver).

As will be appreciated, for a given syrup pump 20 the number of rotations of the rotor 26 (i.e. pumping actions of the syrup pump 20) in a predetermined period of time determines the volume of syrup delivered by the syrup pump 20 during that period of time (i.e. the total number of doses of syrup 20 delivered in that period of time). The rate of delivery of the syrup by the syrup pump 20 is, therefore, dependent on the rate of the pumping actions of the syrup pump 20. The syrup pump 20 may be driven by a motor (which may be a brushed DC motor) which may form part of the syrup pump 20. A mechanical coupling between a rotor of such a motor to the syrup pump 20 may be a constant coupling during normal operation—in other words, without any mechanism to decouple rotation of the rotor of the motor from the operation of the syrup pump 20 (as may otherwise be provided if there were a clutch mechanism between the rotor of the motor and the syrup pump 20, for example). The coupling between the motor and the syrup pump 20 may, therefore, be a clutchless coupling.

The water delivery system 14 may include a water conduit 52. The water conduit 52 is connectable to a water source 58 (for example, mains water).

The water delivery system 14 may include a water pump 56 which is configured to pump water, through the water conduit 52 (or otherwise) towards the dispensing valve assembly 16. In some embodiments, the water delivery system 14 is a carbonated water delivery system 14, wherein the after pump 56 is configured to pump water through the water conduit 52 (or otherwise) into a carbonation device 54 of the carbonated water delivery system 14. Accordingly, for the avoidance of doubt, the carbonated water delivery system 14 may include the carbonation device 54, in some embodiments.

The carbonation device 54 may be configured to receive water from the water source 58 (e.g. via the water conduit 52 and water pump 56) and may also be configured to receive carbon dioxide through a carbon dioxide conduit 50 of the carbonated water delivery system 14.

The carbon dioxide conduit 50 may be connectable to a source of carbon dioxide such as a pressurised carbon dioxide source 52 (for example, a pressurised gas canister). The carbon dioxide conduit may be configured to feed carbon dioxide from the source of carbon dioxide into the carbonation device 54.

The carbonated water delivery system 14 may, therefore, be configured to receive water and carbon dioxide, and to dissolve the carbon dioxide in the water to produce carbonated water.

The carbonation device 54 may be configured to feed carbonated water to the dispensing valve assembly 16.

In some embodiments, the carbonation device 54 may include a reservoir 59 of water and carbon dioxide. The reservoir 59 may be pressurised, so that a desired amount of carbon dioxide gas dissolves into the water in order to produce carbonated water.

The carbonated water delivery system 14 may be configured to provide a substantially continuous supply of carbonated water on demand for delivery to the dispensing valve assembly 16. Similarly, the water delivery system 14 (for the delivery of uncarbonated water) may be configured to provide a substantially continuous supply of uncarbonated (i.e. still) water on demand for delivery to the dispensing valve assembly 16.

In some embodiments, the drinks dispensing system 10 is configured to provide both carbonated and uncarbonated water via the dispensing valve assembly 16. Accordingly, in some embodiments, the drinks dispensing system 10 may include both a still water delivery system 14 and a carbonated water delivery system 14. Accordingly, the drinks dispensing system 10 may include two water conduits 52 and water pumps 56—one for each water delivery system 14. These two water delivery systems 14 may operate independently of each other in some embodiments.

Figure 4:
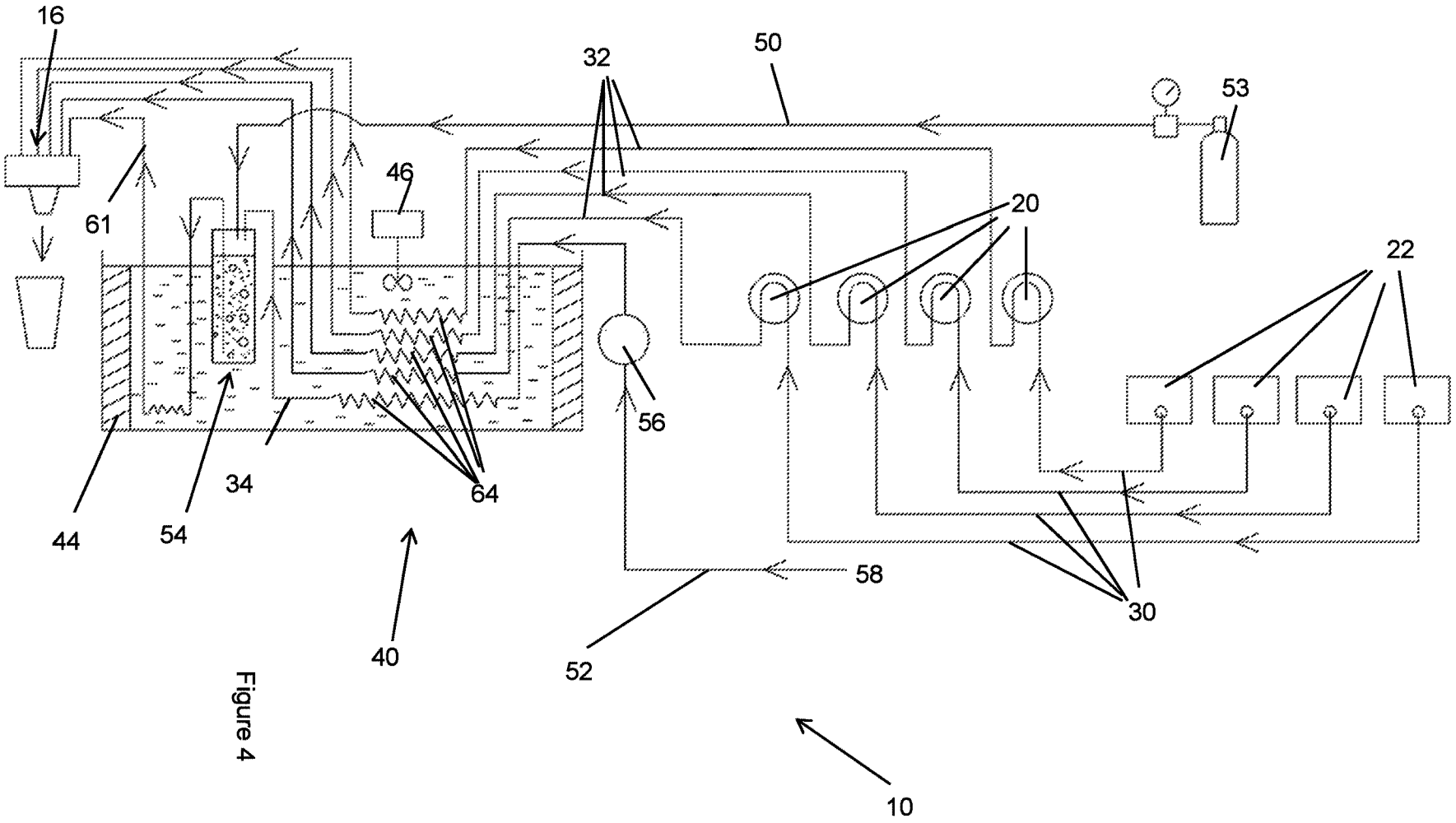
FIG. 4 shows a schematic view of a drinks dispensing system in accordance with some embodiments of the invention.
Figure 5:
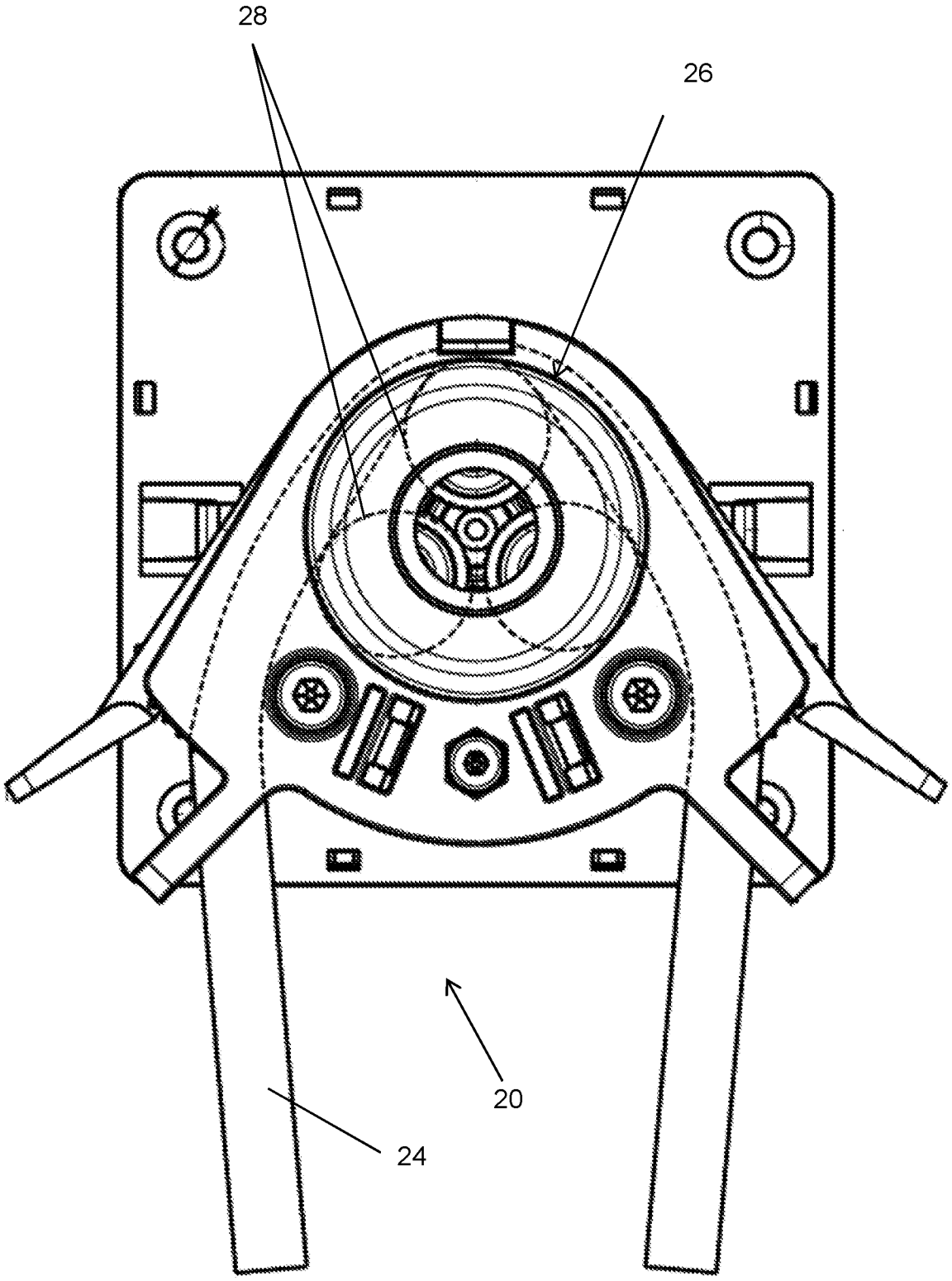
FIG. 5 shows a view of a pump for use in a drinks dispensing system in accordance with some embodiments of the invention.

In some embodiments (for example, FIG. 4), multiple syrup pumps 20 may be provided, each of which is connectable to a respective syrup container 22. It should be appreciated that any number of syrup pumps 20 may be provided, as required. Each syrup container 22 may contain a different flavour syrup or otherwise contain a different type of syrup, for example, cola, diet cola or lemonade. In some embodiments, each syrup pump 20 is associated with its own motor. In some embodiments, each motor is configured to drive only a single syrup pump 20. In some embodiments, four brushed DC motor driven peristaltic pumps may be provided as the syrup pumps 20. Each peristaltic pump may include its own motor which is configured to drive operation of that single peristaltic pump 20 (e.g. as described above).

Different syrups may have different viscosities (for example, diet drinks typically have lower viscosities than their "full sugar" equivalents), and as a result the syrup pump 20 needs to be tuned for a particular syrup, so that the desired dose of syrup is delivered to the dispensing valve assembly 16. In some embodiments, the electrical power provided to operate the syrup pump 20 (or pumps) is controlled in order to control the volume of syrup delivered by the syrup pump 20 over a predetermined period of time (i.e. the rate of syrup delivery by the syrup pump 20). In other words, the electrical power is varied to control the number of pump operations in the predetermined period. In some embodiments, the electrical power is provided to the motor of the syrup pump 20 and the electrical power may be varied to control one or more of the rate of rotation of a rotor of the motor and/or the torque of the rotor of the motor.

In some embodiments, a voltage applied to the syrup pump 20 (e.g. to the motor thereof) is adjustable or otherwise controllable, so that the syrup pump 20 delivers the correct dose of syrup. A higher voltage may, for example, mean a higher number of pump actions in a predetermined period of time and so a faster rate of delivery (i.e. flow rate) of a given syrup. Different syrups may, however, have different properties (e.g. viscosities). Therefore, to obtain a predetermined rate of delivery the voltage applied to the syrup pump 20 (e.g. to the motor thereof) may need to be higher for a high viscosity syrup than for a low viscosity syrup.

In embodiments which use, for example a peristaltic pump as a syrup pump 20, the flow rate may comprise a rate of delivery of a series of individual doses which collectively form the overall dose for the drink, for example.

In some embodiments, the voltage provided to the or each syrup pump 20 (e.g. to the or each motor) may be between around 10 and 30 volts (DC).

In some embodiments, the position of the syrup container 22 with respect to the dispensing valve assembly 16 may also require control of the electrical power supplied to the or each syrup pump 20 (e.g. to the motor(s) thereof).

For example, if the syrup container 22 is below the dispensing valve assembly 16 then more electrical power may be required to deliver the required dosage to the dispensing valve assembly 16 compared to when the syrup container 22 is above the dispensing valve assembly 16. The electrical power supplied to the syrup pump 20 (e.g. to the motor) may be varied by controlling the voltage applied to the syrup pump 20 (e.g. to the motor)—a higher voltage resulting in more power being supplied.

A control system 200 is configured to control the drinks dispensing system 10. The control system 200 may include one or more controller(s) 202 which are coupled to the or each syrup pump 20. There may be one controller 202 for a plurality of syrup pumps 20 or a single controller 202 for each syrup pump 20. The controller(s) 202 is configured to control the electrical power supplied to the coupled syrup pump or pumps 20. The or each controller 202, therefore, may include an interface 204 configured to receive user input to set an electrical power parameter for the electrical power to be supplied to the coupled syrup pump or pumps 20. The electrical power parameter may be a voltage level, for example.

In some embodiments, the or each controller 202 includes a processor 210 (such as a microcontroller or other microprocessor) including a control program which is configured to control the operation of the coupled syrup pump or pumps 20.

The interface 204 may, therefore, include one or more buttons 206 and may also include a display 208 to indicate the present electrical power parameter setting—the buttons 206 and processor 210 being configured to allow a user to alter the electrical power parameter setting (the alteration being indicated in the display). In some embodiments, which may or may not use a processor 210, the interface 204 is in the form of a dial or other manually operated control which can be moved between a first and second position to vary the electrical parameter setting and which also provides a visual indication of the present electrical parameter setting. In some embodiments, the interface 204 is part of a separate maintenance tool which may be communicatively coupled to the or each controller 202 (e.g. by a wired or wireless connection) during maintenance procedures.

As will be appreciated, each syrup pump 20 in embodiments including a plurality of syrup pumps 20 may be associated with its own electrical power parameter which may be set independently of the other electrical power parameters for the other syrup pumps 20. The electrical power parameter may determine one or more of the rate of rotation of a rotor of the motor of the associated syrup pump 20 and/or the torque of the rotor of the motor of the associated syrup pump 20. Accordingly, different operating conditions can be set for each syrup pump 20 to allow for different syrups and different syrup container 22 locations, for example.

The electrical parameter setting may then be used by the or each controller 202 to control the operation of one or more electrical power delivery systems of the drinks dispensing system 10—e.g. to vary the voltage applied to the or each motor of the respective syrup pump or pumps 20 coupled to that controller 202.

The one or more electrical power delivery systems may each be coupled to a respective syrup pump 20—the or each electrical power delivery system being configured to control the electrical power provided to the associated syrup pump 20 (e.g. to the motor thereof). In some embodiments, there is a single electrical power delivery system for a plurality of syrup pumps 20.

In some embodiments, the or each controller 202 may be further configured to receive a command for the dispensing of a drink and to control the duration of the electrical power delivered to the or each syrup pump 20. As will be appreciated, therefore, the or each electrical power delivery system may include one or more electrical switches which are configured to control the delivery of electrical power to the or each syrup pump 20 (e.g. to the or each motor thereof). The command for dispensing of a drink may be provided by an operator interface 66 which may be configured to receive operator indications of the desired drink to be dispensed. The operator interface 66 may be provided such that it is viewable and can be operated from the outside of the housing 100.

In some embodiments, the or each controller 202 is configured to receive the command for dispensing of a drink and to operate the associated syrup pump 20 (using the relevant electrical power delivery system). The controller 202 may operate the syrup pump 20 for a period equal to the length of time the command is received (e.g. whilst the operator is actuating the operator interface) or for a predetermined length of time (e.g. to dispense a predetermined volume of drink).

In some embodiments, the controller(s) 202 include a variable resistor provided as part of a potential divider circuit. The or each syrup pump 20 may be coupled to the one or more electrical power delivery systems via a respective potential divider circuit (each including a variable resistor). The user interface 204 to set the electrical parameter setting may include an interface (such as a dial, knob, or feature for engagement with a tool) through the use of which the resistance of the variable resistor can be set. Such potential dividers may, therefore, be used to set the voltage applied to each syrup pump 20 (e.g. motor) as a proportion of the voltage supplied by the electrical power delivery system.

In some embodiments, the electrical parameter setting for the or each syrup pump 20 may be set directly by the user/technician according to their own knowledge (or information provided) of the effect of the position of the or each syrup container 22 and the type of syrup to be pumped. For example, a full sugar syrup (i.e. higher viscosity) may require a supply voltage of around 27 volts if the syrup container 22 is substantially level with the dispensing valve assembly 16. A voltage supply of around 30 volts may be required if the syrup container 22 is around 1 to 2 metres below the dispensing valve assembly 16. A diet syrup (i.e. lower viscosity), for example, may only require a voltage of around 24 volts if the syrup container 22 is level with the dispensing valve assembly 16. The voltage may not need to be adjusted even if the syrup container 22 is around 1 to 2 metres below the dispensing valve assembly 16.

As will be appreciated the electrical parameter setting may, in some embodiments, be individually set for each syrup pump 20 and may, in some embodiments, be different for each syrup pump 20.

In some embodiments, the dispensing system 10 may be configured to set the electrical parameter setting (e.g. voltage) required for the syrup pumps 20 automatically. This may be based on input data about the type of syrup in the or each syrup container 22 and/or the system's knowledge of where the syrup container 22 will be or is located in the dispensing system 10.

In some embodiments, the drinks dispensing system 10 may include a cooling system 40. The cooling system 40 may include a single mechanism which is configured to cool both the syrup travelling towards the dispensing valve assembly 16 and the water travelling to and/or from the carbonation device 54 (or otherwise passing through the water delivery system 14 (be it the carbonated water delivery system 14 or uncarbonated water delivery system 14, or both in some embodiments)).

The cooling system 40 is configured to reduce the temperature of the syrup and/or the water to a desired chilled temperature (i.e. a temperature lower than room temperature (e.g. lower than about 20° C.)). In some embodiments, more than one cooling system 40 may be provided for each of the syrup delivery system 12 and the or each water delivery system 14, as desired.

The cooling system 40 may include a water bath 42 through which syrup and water conduits 32, 34 pass. The water bath 42 may be cooled by an ice bank 44. In some embodiments, the ice bank 44 substantially surrounds a perimeter of the water bath 42. The ice bank 44, as will be understood, comprises a coolant conduit which carries a coolant. The coolant is chilled using refrigeration equipment of the cooling system 40—e.g. using a refrigeration cycle—and the chilled coolant cools the water in the water bath 42. The coolant conduit may be configured to build a bank of ice within the water bath 42. The ice bank 44 is, therefore, used to chill and maintain the chilled temperature of the water bath 42.

The water bath 42 may further be insulated to help to maintain low temperature of the water bath 42.

The cooling system 40 may further include a mixing device 46 which is configured to mix or otherwise agitate the water in the water bath 42 in order to maintain a substantially consistent temperature across the water bath 42.

In some embodiments with multiple syrup pumps 20 multiple syrup conduits 32 are provided. As will be understood, each syrup conduit 32 (be there one or several) couples one of the syrup pumps 20 to the dispensing valve assembly 16 and may pass through the cooling system 40, if provided. The syrup conduit 32 may be a part of the cooling system 40, or a part of the syrup delivery system 12 or may be connected to either system.

In embodiments including multiple syrup conduits 32, the multiple syrup conduits 32 may all pass through the water bath 42 for cooling. The or each syrup conduit 32 may, in some embodiments, take the form of a coil 64 within the water bath 42.

In some embodiments, the or each water delivery system 14 includes a respective water conduit 34—which may be configured to carry water to the dispensing valve assembly 16 or the carbonation device 54 as the case may be. The water conduit 34 (or conduits) may pass through the water bath 42 (as described above). One of the water conduit(s) 34 may be coupled to the water source 58 (e.g. via the water pump 56) and the carbonation device 54 and configured to deliver water from the water source 58 to the carbonation device 54 for carbonation. In some embodiments, one of the water conduit(s) 34 may be coupled to the water source 58 (e.g. via the water pump 56) and configured to deliver water from the water source 58 to the dispensing valve assembly 14. The water conduit(s) 34 may be a part of the cooling system 40, or a part of the water delivery system 14 (which may be the carbonated water delivery system 14 or not) or may be connected to either system The or each water conduit 34 may each take the form of a coil 64 within the water bath 42.

At least part of the carbonation device 54 may be configured to be cooled by the cooling system 40 and may be provided within the water bath 42, in some embodiments. In embodiments in which the carbonation device 54 includes a pressurised reservoir 59, the pressurised reservoir 59 may also be cooled by the cooling system 40 (e.g. the reservoir 59 may be positioned at least partially in the water bath 42).

A further water conduit 61 may be provided to couple the carbonation device 54 to the dispensing valve assembly 16, such that carbonated water can be provided via a further water conduit 61 (or "carbonated water conduit") to the dispensing valve assembly 16.

The further water conduit 61 may be chilled by the cooling system 40 (and may, therefore, pass through the water bath 42). The carbonated water conduit 61 may be a part of the cooling system 40, or a part of the carbonated water delivery system 14 or may be connected to either system.

In some embodiments in which a water delivery system 14 is provided for still water, there may be a still water reservoir (not shown) configured to be cooled by the cooling system 40 (e.g. may be located at least partially within the water bath 42). Accordingly, the water conduit 34 may deliver water to the still water reservoir and another further water conduit (corresponding with water conduit 61) may be provided to deliver water from the water reservoir to the valve dispensing assembly 16.

As will be appreciated, therefore, the cooling system 40 may be used to cool (i.e. chill) the syrup and the water (before and/or after carbonation of the water and/or of still water). As discussed above, each conduit 32, 34, 61 which passes through the water bath 42 may include a coil 64 to increase the length of conduit 32, 34, 61 which is in contact with the cooled water.

The dispensing valve assembly 16 may be configured to engage the or each of the syrup conduits 32 and the further water conduit 61. The dispensing valve assembly 16 may be configured to engage the other further water conduit (for delivering still water) in some embodiments—in addition to or instead of the further water conduit 61 for carbonated water.

Figure 6:
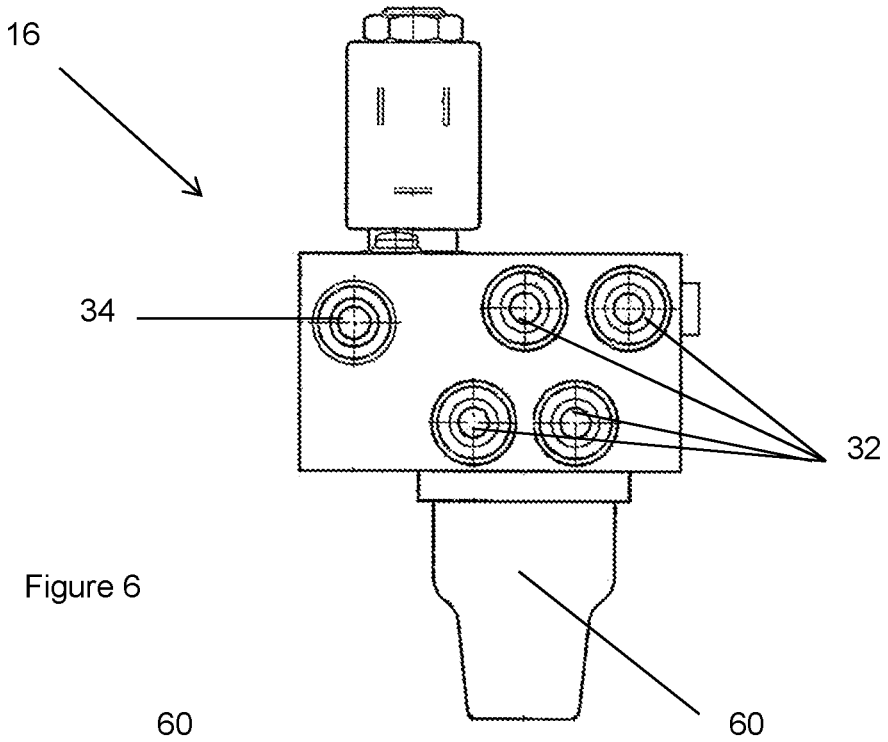
FIG. 6 shows a back view of a dispensing valve assembly for use in a drinks dispensing system in accordance with some embodiments of the invention.
Figure 7:
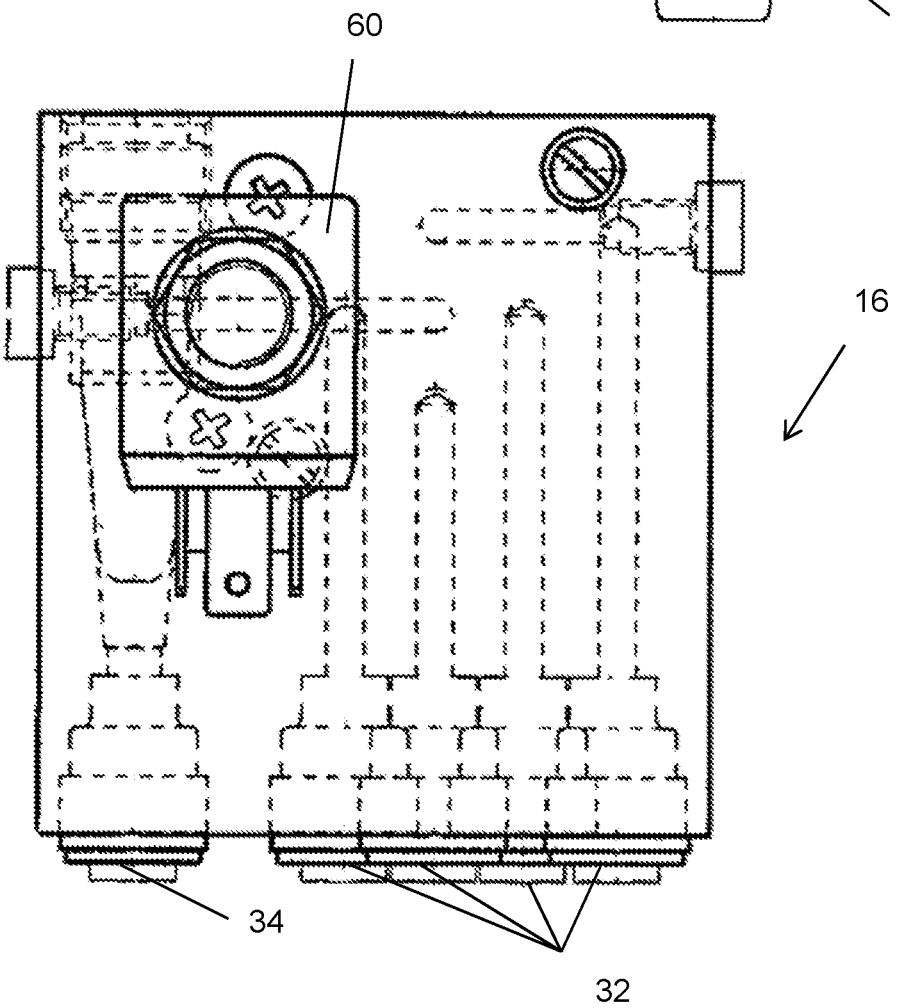
FIG. 7 shows a partially cut away plan view of a dispensing valve assembly for use in a drinks dispensing system in accordance with some embodiments of the invention.
Figure 8:
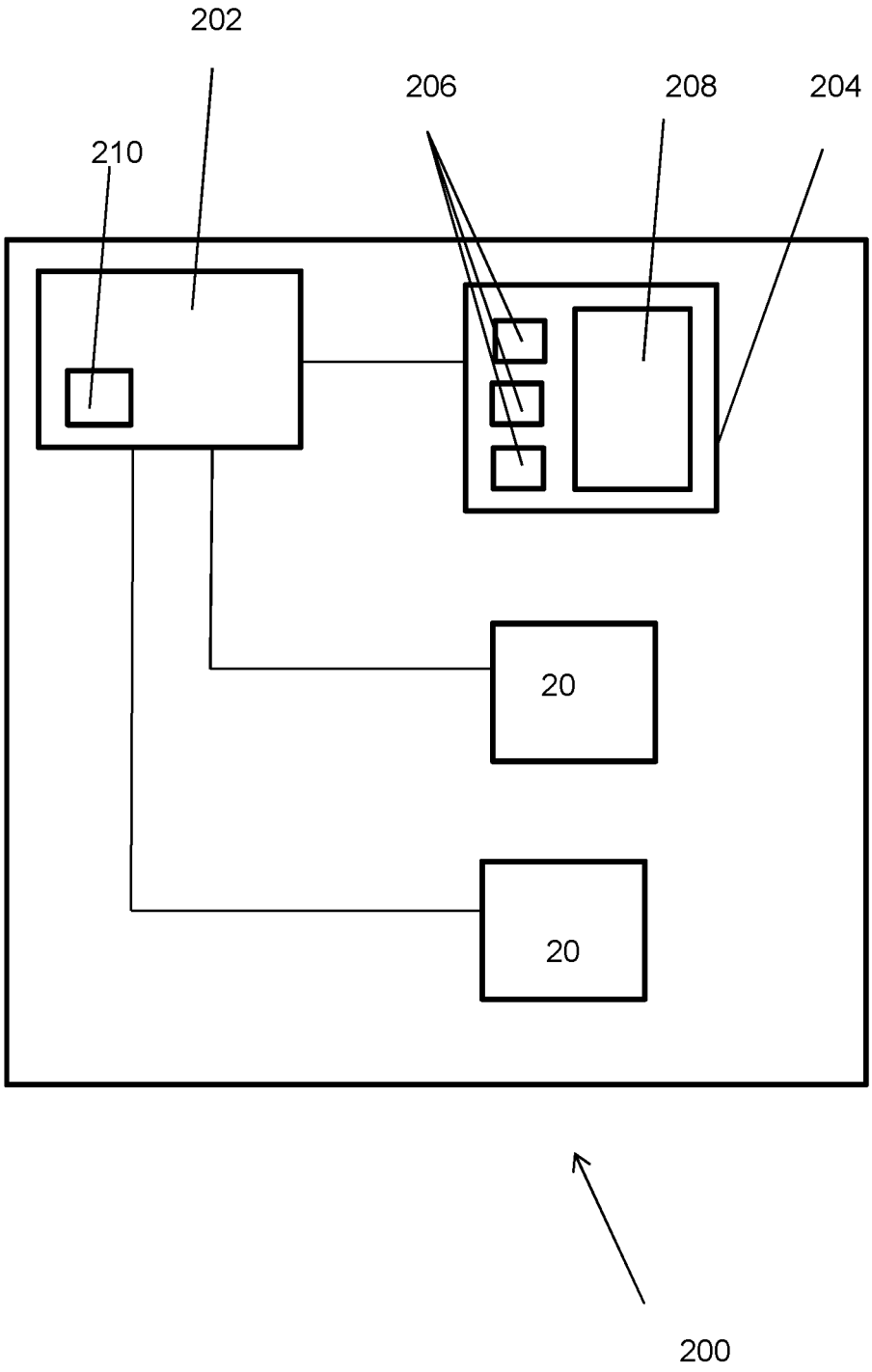
FIG. 8 shows a control system in accordance with some embodiments of the invention.

With reference to FIGS. 6 and 7, the dispensing valve assembly 16 may include a nozzle 60, through which soft drink is dispensed. The dispensing valve assembly 16 may include a mixing chamber (not shown) in or just before the nozzle 60, so that syrup and water (which may or may not be carbonated) may be mixed together as it is dispensed (or just before it is dispensed). The dispensing valve assembly 16 may include one or more operator actuatable control members 66, which correspond to the flavour of drink required.

In use, a operator activates the operator actuatable control member 66 which relates to the desired soft drink, which activates the drinks dispensing system 10 (e.g. the or each operator actuatable control member 66 may be the above described operator interface and may trigger the issuance of the command to dispense the drink).

The relevant syrup pump 20 is then driven to provide the correct dose of syrup to the dispensing valve assembly 16 (and the syrup may travel through the cooling system 40 for chilling as it flows towards the dispensing valve assembly 16). The carbonation device 54 may be pressurised at a pressure greater than that of atmosphere, so that when the dispensing valve assembly 16 is activated (i.e. opened to atmosphere), the carbonated water is automatically forced towards the dispensing valve assembly 16 due to the pressure differential—e.g. if a carbonated soft drink was selected by the operator. In some embodiments, the water is not carbonated (e.g. because the operator selected an uncarbonated drink. In such embodiments, the water pump 56 may deliver water to the dispensing valve assembly 16 (via the still water reservoir or otherwise).

In some embodiments the further water conduit 61, which connects the carbonation device to the dispensing valve assembly 16, is a relatively straight path. If the carbonated water travels along a torturous path (i.e. a twisted further water conduit 61) then the concentration of carbon dioxide in the water may be reduced, resulting in a soft drink which has reduced carbonation than is ideal.

The syrup dose and the water (carbonated or still) will, in use, enter the dispensing valve assembly 16 to be mixed by the dispensing valve assembly 16 (e.g. in the nozzle 60 thereof) and dispensed from the nozzle 60.

In some embodiments, the ideal mixing ratio between the syrup and the water is about 1:5 by volume. The dispensing valve assembly 16 may be configured to provide fine control of the water flow rate. This may be achieved by one or more valve members, for example, of the dispensing valve assembly 16.

However, since the different syrups have different viscosities no fine tuning of the flow rate/dose of the syrup is performed using the dispensing valve assembly 16 (since the dispensing valve assembly 16 would need to be adjusted every time a different syrup was used)—the flow rate/dose of the syrup may be entirely controlled by the relevant syrup pump 20 (i.e. by the speed of rotation (i.e. rpm) of the syrup pump 20 and/or the electrical power supplied to the syrup pump 20 and/or the configuration of the syrup pump 20 and/or the cross-section of the syrup conduit 32).

Once the desired volume of soft drink has been dispensed from the dispensing valve assembly 16 (i.e. once substantially all the syrup has been mixed with water and dispensed), the dispensing system 10 may be configured to flush the dispensing nozzle 16 with water (a "post wash") which may be carbonated or still water. This may be advantageous to prevent substantial flavour cross-over. For example, if a first soft drink dispensed is cola and a second drink is lemonade, it is advantageous if all of the cola syrup is flushed into the first drink, so that the second, lemonade, drink is not tainted with cola residue. In some embodiments, the dispensing system 10 may flush the dispensing valve assembly 16 with water for between around 0.1 and 1 seconds (for example, the flush time may be 0.5 seconds). The post wash operation may be controlled by the controller (s).

In some embodiments, the carbonation device 54 may include a pressure regulator to maintain a substantially constant predetermined pressure (for example, it may be kept at a pressure of between about 760 Pa (110 psi) and 830 Pa (120 psi)). When a soft drink is dispensed from the dispensing valve assembly 16, the pressure in the carbonation device 54 reduces because carbonated water is fed out of the carbonated water delivery system 14 (for example, the pressure may drop to around 550 Pa (80 psi)). Once the dispensing system 10 completes dispensing a soft drink, the carbonation device 54 may automatically draw additional carbon dioxide from the carbon dioxide source 53 and additional water may be pumped from the water source 58, so that the pressure is brought back to the predetermined pressure. This may be controlled by the controller(s).

In some embodiments, under operator control, the drinks dispensing system 10 may be configured to output still or carbonated water through the dispensing valve assembly 16 with or without syrup. As such, an operator may request the dispensing of unflavoured water from the drinks dispensing system 10 of some embodiments. Equally, of course, in some embodiments, the drinks dispensing system 10 may be configured to output still and/or carbonated water flavoured with at least one syrup.

In some embodiments in which the dispensing system 10 is configured to output still and carbonated water, a single water source 58 may be provided. In some embodiments, a single water pump 56 is provided and the output of the water pump 56 is split such that a portion of the water from the water source 58 is provided to the carbonation device 54 and a portion is provided to the dispensing valve assembly 14 without carbonation (i.e. as still water).

In some embodiments, the drinks dispensing system 10 may have multiple modes of operation. The modes may include a dispense mode, a user mode and a technician mode. Dispense mode may be 'normal' operation which allows the end user (i.e. the operator) to activate the dispensing system 10 and dispense a required flavour of soft drink. This mode may set particular details of the use of the system 10. For example, the time taken to fill a 300 ml cup may be between about 6 and 7 seconds, so the dispensing system 10 may have a maximum dispense time of 10 seconds to prevent flooding and/or misuse (i.e. filling large containers with soft drink when only a small amount has been purchased). The dispensing system 10 may be set to allow only one type of syrup to flow at a time, even if more than one control member 66 is actuated.

User mode may allow a proprietor (e.g. a coffee shop owner) to perform specific tasks. User mode may be accessed by pressing a specific sequence of control members 66. Once in user mode the dispensing system 10 may allow empty syrup containers 22 to be replaced with new ones and/or prevent further use of the dispensing system 10 (i.e. if there is a fault and the dispensing system 10 cannot be used until a technician has investigated).

Technician mode may allow further control of the dispensing system 10. For example, technician mode may allow the or each electrical power for each syrup pump 20 to be adjusted and/or may allow isolation of the carbonation device 54 (or other components of the syrup delivery system 12 and/or the carbonated water delivery system 14), so that it can be fixed if required. It should be appreciated that examples of what may be programmed in each operation mode is not exhaustive.

The controller(s) may be configured to determine the mode of operation.

The dispensing system 10 may be conveniently in a compact housing 100, so that it may be placed on a counter top, and does not take up excessive space.

As will be appreciated, embodiments of the present invention may allow operating parameters of the syrup pumps 20 to be controlled independently of each other to allow for different conditions (e.g. different syrups and/or syrup container 22 locations). The operating parameters are, in embodiments, parameters of the electrical power which is used to power a respective motor associated with each syrup pump 20 (or forming a part thereof).

In some embodiments, the cooling system 40 is provided as a remote cooling system 40. The remote cooling system 40 may be provided in a separate housing. An umbilical may couple the remote cooling system 40 to the rest of the dispensing system 10. In some embodiments, the dispensing valve assembly 16 is provided in a separate housing and coupled to the rest of the dispensing system 10 by the umbilical. In some embodiments, the cooling system 40 may include a chilled liquid pump which is configured to circulate chilled liquid (e.g. water) from the cooling system 40 (e.g. from the water bath) through at least part of the umbilical and back to the cooling system 40 (e.g. back to the water bath). This chilled liquid pump may be provided in addition to or instead of the mixing device 46. In some embodiments, the chilled liquid pump is configured to deliver the chilled liquid to the dispensing valve assembly 16 for circulation around a part thereof and return to the cooling system. Accordingly, this chilled liquid may cool water and/or syrup which is in the umbilical and/or near the dispensing valve assembly 16. This may help to ensure that the drink is still adequately chilled during periods in which a low volume of drink is dispensed.

In some embodiments, the operator interface 66 is provided as part of the same housing (e.g. on that housing) as the dispensing valve assembly 16 which may be a separate housing from the housing for at least part of the rest of the dispensing system 10 (which may be all of the rest of the dispensing system 10 and/or may be the housing for the cooling system 40).

In some embodiments, the umbilical may also include one or more electrical wires which are configured to provide electrical power to the housing as part of which the operator interface 66 is provided and/or to deliver the output from the operator interface 66 to the or each controller 202 (which may be provided in the remote housing).

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A drinks dispensing system for dispensing drinks comprising:

a dispensing valve assembly;

a syrup delivery system comprising:

a first syrup pump for direct connection to a first syrup container, the first syrup pump being a peristaltic pump, and being controllable to deliver a predetermined dose of syrup from the first syrup container directly to the dispensing valve assembly via a first syrup conduit wherein a first end of the first syrup conduit is connected to the first syrup pump and a second end of the first syrup conduit is connected to the dispensing valve assembly, and a second syrup pump for direct connection to a second syrup container, the second syrup pump being a peristaltic pump, and being controllable to deliver a predetermined dose of syrup from the second syrup container directly to the dispensing valve assembly via a second syrup conduit wherein a first end of the second syrup conduit is connected to the second syrup pump and a second end of the second syrup conduit is connected to the dispensing valve assembly;

a control system configured to control the operation of the first and second syrup pumps by setting a first electrical power parameter of electrical power to be supplied to drive the first syrup pump independently of a second electrical power parameter of electrical power to be supplied to drive the second syrup pump and wherein operation of the peristaltic syrup pumps solely controls the syrup delivered to the dispensing valve assembly via the first and second syrup conduits;

a water delivery system configured to deliver water to the dispensing valve assembly via a water conduit; and a single cooling mechanism including a water bath through which the water conduit and the first and second syrup conduits pass before connecting to the dispensing valve assembly, so that the syrup and water is delivered to the dispensing valve assembly directly after passing through the cooling system;

wherein the dispensing valve assembly is operable to mix and dispense syrup and water provided by the syrup delivery system and the water delivery system.

2. A system according to claim 1, wherein the control system is configured to set the first and second electrical power parameters to different settings.

3. A system according to claim 1, wherein the electrical power parameter is a voltage of the electrical power to be supplied to the first and second syrup pumps.

4. A system according to claim 1, wherein the control system includes a first controller associated with the first syrup pump and a second controller associated with the second syrup pump, each controller being configured to receive operator input to set the respective first and second electrical power parameters.

5. A system according to claim 1, wherein the control system is further configured to:

receive a command to dispense a drink;

control the delivery to the dispensing valve assembly of a syrup using first syrup pump; and control the delivery of water to the dispensing valve assembly using the water delivery system, such that water only is dispensed during a final period of the dispensing of the drink in order to flush the dispensing valve assembly.

6. A system according to claim 1, further including a third syrup pump for connection to a third syrup container, the third syrup pump being controllable to deliver a predetermined dose of syrup from the third syrup container to the dispensing valve assembly, wherein the control system is further configured to control the operation of the third syrup pump by setting a third electrical power parameter of electrical power to be supplied to drive the third syrup pump independently of the first and second electrical power parameters.

7. A system according to claim 1, wherein the syrup delivery system, the water delivery system and the dispensing valve assembly are all housed within or on a single housing.

8. A system according to claim 1, wherein the syrup delivery system further includes a container for housing a replaceable syrup bag.

9. A system according to claim 1, wherein the dispensing valve assembly is configured to control the flow rate of water from the water delivery system.

10. A system according to claim 1, wherein the dispensing valve assembly is configured to pass the syrup from the first and second syrup containers without providing control over the flow rate of the syrup.

11. A system according to claim 1, wherein the water delivery system includes a carbonation device having a pressurised reservoir of water and carbon dioxide.

12. A system according to claim 11, wherein the carbonation device is configured to refill the reservoir to a predetermined level after a drink has been dispensed.

* * * * *